US005899429A

United States Patent [19]

McCloud

[11] Patent Number: 5,899,429

[45] Date of Patent: May 4, 1999

[54] EASEL WITH INTEGRAL PAINTBRUSH CLEANING ASSEMBLY

[76] Inventor: Jerry L. McCloud, 7848 Oakland Hills Ct., Pickerington, Ohio 43147

[21] Appl. No.: 08/877,964

[22] Filed: Jun. 18, 1997

[51] Int. Cl.[6] ..... A47B 19/00

[52] U.S. Cl. ..... 248/441.1; 248/449; 248/312.1; 248/455; 248/97; 248/188.2; 134/6; 134/38; 134/900; 134/201

[58] Field of Search ..... 248/441.1, 449, 248/451, 188.5, 312.1, 455, 99, 100, 460, 462, 463, 465, 95, 97, 188.2; 134/6, 38, 900, 201; 68/213

[56] References Cited

U.S. PATENT DOCUMENTS

| | | | |
|---|---|---|---|
| 514,182 | 2/1894 | English et al. | 248/451 X |
| 3,360,319 | 12/1967 | Hocking | 248/449 X |
| 3,595,507 | 7/1971 | Kurlander | 248/97 |
| 4,358,083 | 11/1982 | Haubrich | 248/100 X |
| 4,848,243 | 7/1989 | Giordano | 248/455 X |
| 4,911,191 | 3/1990 | Bain | 134/201 X |
| 5,078,348 | 1/1992 | Babitchenko | 248/460 X |
| 5,320,319 | 6/1994 | Winger et al. | 248/312.1 |
| 5,725,192 | 3/1998 | Cloninger | 248/455 X |

FOREIGN PATENT DOCUMENTS

| | | | |
|---|---|---|---|
| 565854 | 8/1957 | Italy | 248/441.1 |

*Primary Examiner*—Ramon O. Ramirez
*Assistant Examiner*—Stephen S. Wentsler
*Attorney, Agent, or Firm*—Mueller and Smith, LPA

[57] ABSTRACT

Disclosed is an artists' easel which has a pivotally adjustable frame which carries the artists' canvas. A bag retaining assembly attached to the easel frame is adapted for a bag, e.g., a plastic garbage bag, to fit thereover with a apertured splatter panel covering the mouth of the bag. A beater bar inside the bag frame permits the artist to beat the paintbrush on the beater bar while the bag traps the solvent inside. The easel also is adjustable in height, and has provision for a tray, a paper towel holder, and a container holder (e.g., for solvent). Provision for holding the bag in place is provided also.

15 Claims, 5 Drawing Sheets

26
28
30
16
16b
16a
36
10
20
24
22
63
60
7
7
18
48
52a
14
38
50
46
42
40b
58
85
12
40a
74a
74b
94
86
66b
82
84
90
88
70
64
68b
66a
68a

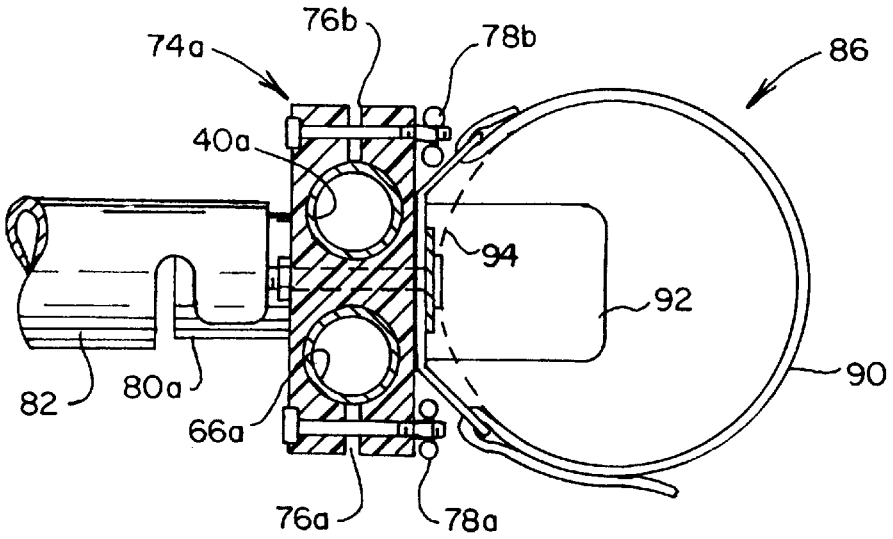
FIG. 8
FIG. 9
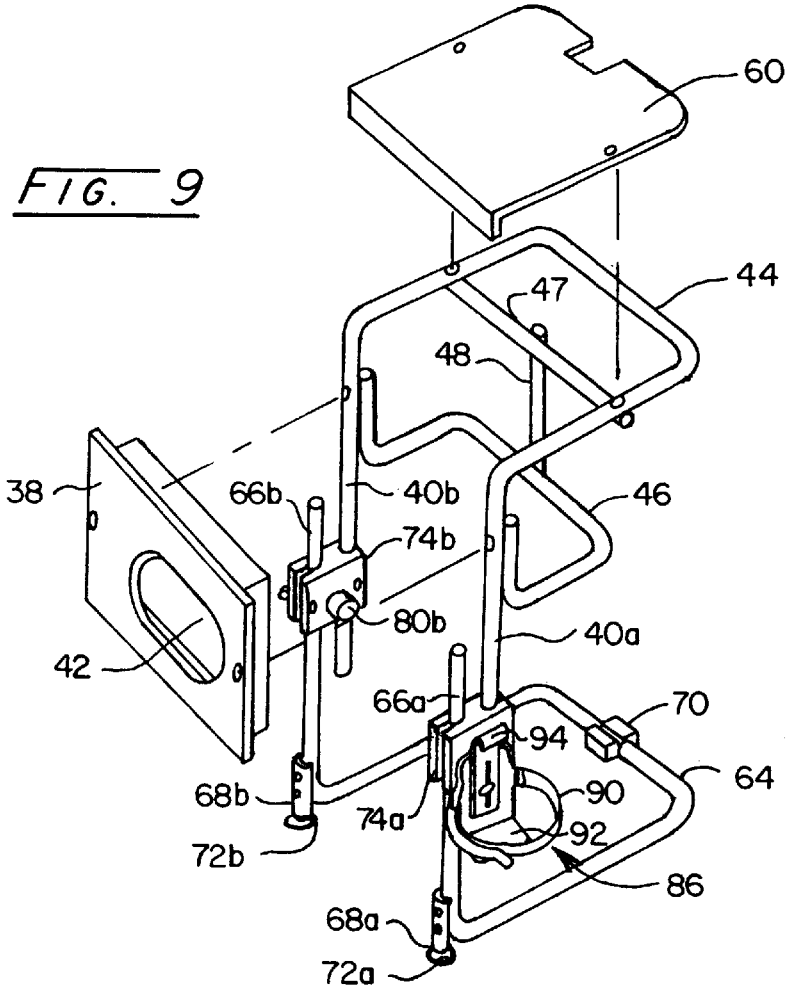

EASEL WITH INTEGRAL PAINTBRUSH CLEANING ASSEMBLY

CROSS-REFERENCE TO RELATED APPLICATIONS

None.

STATEMENT REGARDING FEDERALLY SPONSORED RESEARCH

Not applicable.

BACKGROUND OF THE INVENTION

The present invention relates to artists' easels and more particularly to one which has a paintbrush cleaning assembly for removing paint thinner or other solvent from paintbrushes.

Artists that work with the wet-on-wet technique are constantly changing from one paint color to another paint color. Between each paint color change, the artist must clean the paintbrush, usually with odorless paint thinner, though other paint solvents could be used. A can or jar filled with paint thinner, and usually containing a screen or other device for the brush to rub up against to aid in its cleaning, is used to clean the paint-laden brush. Thereafter, the brush must be dried of the paint solvent, such as by use of paper towels. As an alternative to or adjunct with the use of paper towels, the brush can be dried of solvent rapidly by beating the brush rapidly against a bar. One well-known wet-on-wet technique artist, Bob Ross, enchanted his television audiences by beating his solvent-laden paintbrushes on the lower leg of his easel and quipping that the camera operators and other TV personnel present had to duck when he beat his brush to avoid the splatter that he created. Nevertheless, such operation was quite effective in quickly drying the paintbrush so that he could move on to the next color as required by the wet-on-wet technique.

It would be quite advantageous for all wet-on-wet technique artists to be able to beat their paintbrushes as Bob Ross did on his TV shows. Yet, to do so would create quite a mess, thus limiting where the artist could paint. Moreover, it is not environmentally safe to splatter paint solvent into the atmosphere and onto nearby objects, especially if the artist were outdoors.

Heretofore, some artisans have developed splatter containment for use in the cleaning of paintbrushes. For example, U.S. Pat. No. 4,953,736 proposes a paint splatter box having an open front and drain for the expelled paint thinner to collect in a collection box, A crude easel also is provided. U.S. Pat. No. 4,827,554 proposes a stand for insertion into a conventional wastebasket for cleaning paintbrushes of artists employing the wet-on-wet technique. U.S. Pat. No. 4,494,267 proposes a brush cleaner confined within a housing for similarly cleaning paintbrushes. Other than the '736 patent, none of the other proposals involve an artists easel and none of these proposals include an adjustable artists easel, such as proposed elsewhere. For example, U.S. Pat. No. 3,799,488 discloses an artist's collapsible wall and table mountable easel with U-shaped base. U.S. Pat. No. 4,134,614 discloses a mobile easel and seat having base pegs for hanging a cleaning cloth.

Despite these proposals, there still is a need for a full adjustable artists easel for use by artists who both stand and sit, while also providing splatter containment for use in the cleaning of paintbrushes. The present invention is addressed to such need.

BRIEF SUMMARY OF THE INVENTION

Disclosed is a paintbrush cleaning assembly adapted to be affixed to an easel frame assembly. The easel frame assembly includes a pair of generally parallel upright stand members, a base to support said upright stand members, and a horizontal canvas (or other painting surface) support which extends between said upright stand members. The novel paintbrush cleaning assembly includes an apertured splatter panel affixed to the upright stand members; and a bag retaining assembly which preferably includes an upper elongate bag support member affixed to the upright stand members and spaced a distance back from such members; a lower elongate bag support member affixed to the upright stand members and spaced a distance back from the members. The foregoing design is adapted so that the bag retaining assembly (e.g., upper and lower elongate support members) defines an open cavity having a height which is about the same as the height of said apertured splatter panel. The novel paintbrush cleaning assembly also includes an elongate beater bar which extends vertically within the bag retaining assembly and is carried thereby, e.g., is located between the upper and lower elongate bag support members. The bag retaining assembly (e.g., upper and lower elongate bag support members) is configured to receive a bag, preferably a plastic garbage bag, thereover whose opening mates with the periphery of the apertured splatter panel, so that an artist can extend a hand holding a paintbrush through the aperture in said apertured splatter panel and into the cavity to beat the brush against the beater bar to dispel liquid from the brush.

The easel also is adjustable in height, and has provision for a tray, a paper towel holder, and a container holder (e.g., for solvent). Provision for holding the bag in place is provided also.

Advantages of the present invention include the integration of a unique paintbrush cleaning assembly into a fully-functional easel. Another advantage is the ability to use common plastic garbage bags to retain and collect brush splatter. A further advantage is the provision of an easel that also has provision for a solvent container, paper towel holder, tray for paints and brushes, and a shelf for other artist supplies. These and other advantages will be readily apparent to those skilled in this art based on the disclosure set forth herein.

BRIEF DESCRIPTION OF THE DRAWINGS

FIG. 8 is a sectional view taken along line 8—8 of FIG. 2; and

FIG. 9 is an exploded perspective view of the novel easel.

The drawings will be described in detail below.

DETAILED DESCRIPTION OF THE INVENTION

Figure 1:
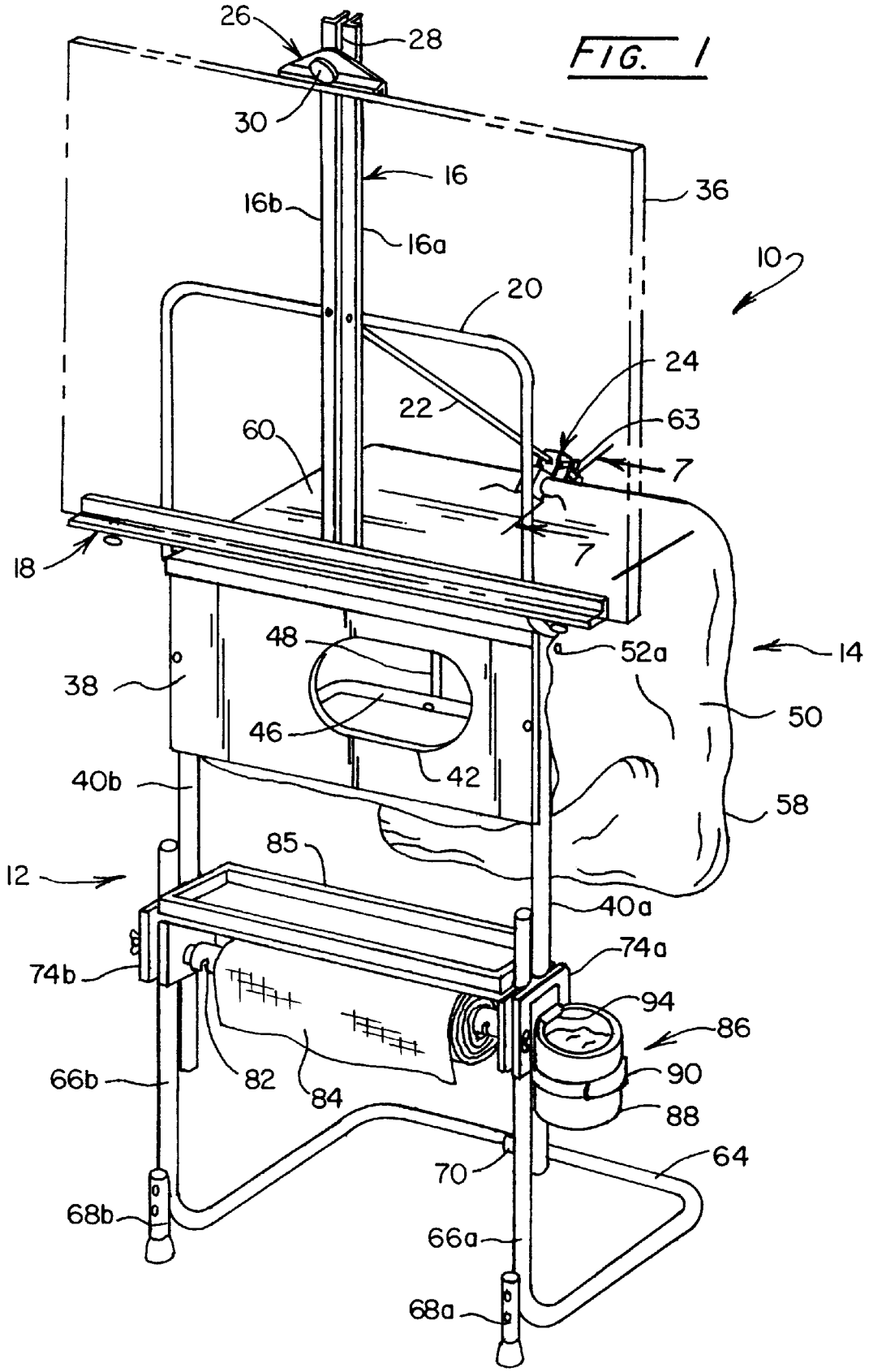
FIG. 1 is a perspective view of the novel easel with paintbrush cleaning assembly.
Figure 4:
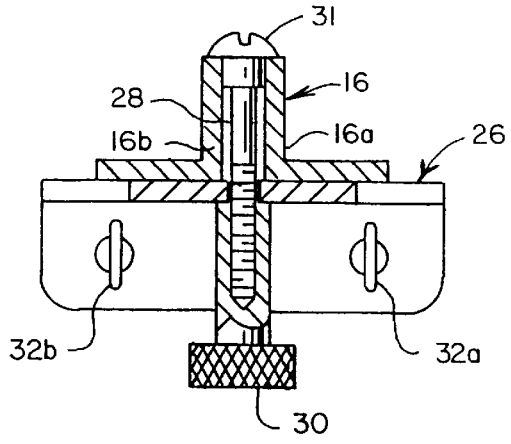
FIG. 4 is a sectional view taken along line 4—4 of FIG. 2.

The inventive artists easel with paintbrush cleaning assembly is depicted generally in FIG. 1 as including easel 10, adjustable stand 12, and paintbrush cleaning assembly 14. Referring to both FIGS. 1 and 2, easel 10 generally is composed of upstanding canvas support bar 16, horizontal canvas support 18, inverted U-shaped easel hinge member 20, and diagonal bar 22 with clamp 24. Canvas support bar 16 is fitted with adjustable clamp 26 which rides in track 28 formed by angles 16a and 16b (see FIG. 4) of canvas support bar 16 and is adjustable along the extend of canvas support bar 16 by knob 30. As shown in more detail in FIG. 4, thumbscrew 30 fits into threaded screw 31 for tightening clamp 26. Clamp 26 also retains thumb screws 32*a* and 32*b* which, along with thumb screws 34*a* and 34*b* in canvas support 18, secure canvas 36 (shown in phantom) in position for the artist to paint. "Canvas" is used in a generic sense herein to indicate a painting surface upon which the artist paints, rather than to indicate a type of material. Thus, any surface upon which an artist desires to paint can be accommodated by the inventive easel disclosed herein. Canvas support bar 16 can be adjusted from a horizontal back to a vertical position by diagonal bar 22 which is pivotally attached to canvas support bar 16 at its upper end and by clamp 24 about its lower end. Clamp 24 will be described in greater detail below in connection with the description of paintbrush cleaning assembly 14. Suffice it to say, that easel 10 is a fully-adjustable easel with provision to securely retain canvas 36 for the artist.

Figure 2:
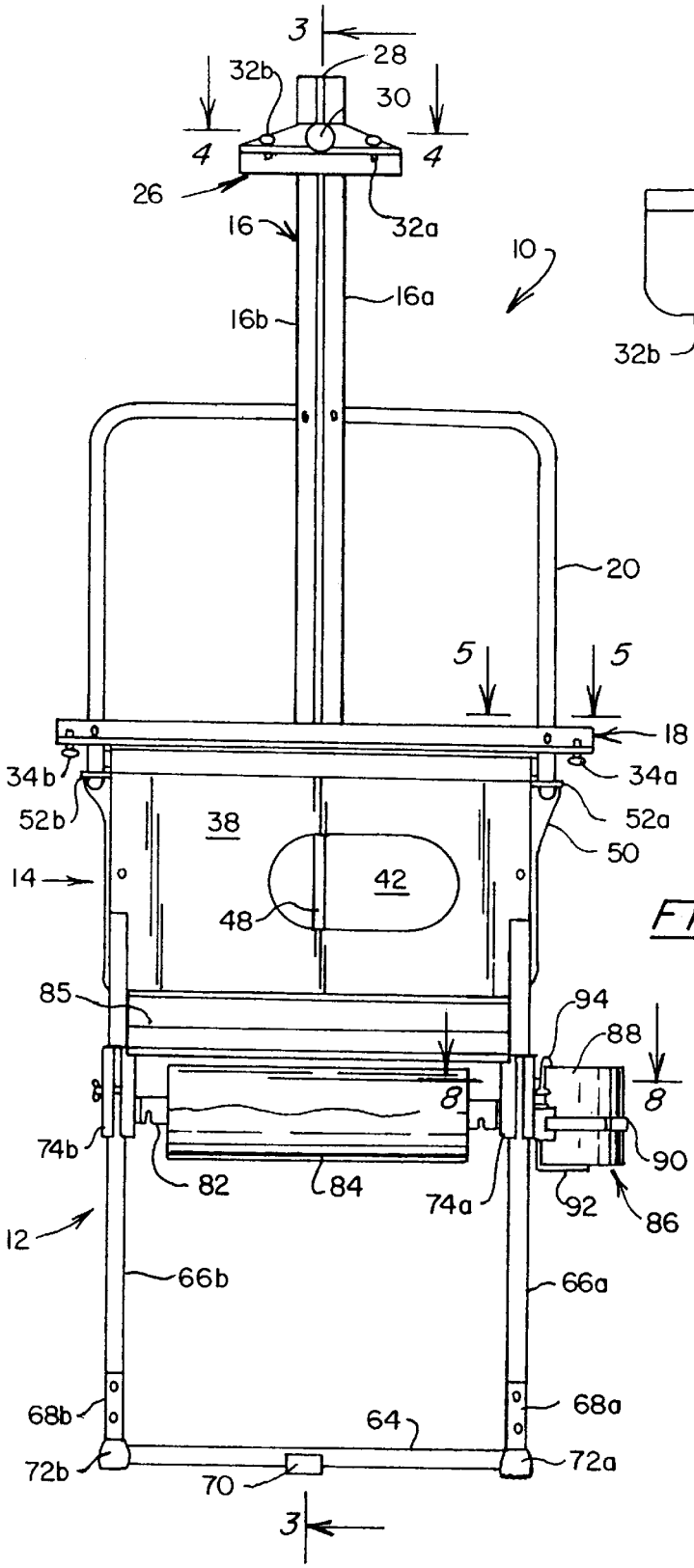
FIG. 2 is a front elevational view of the easel frame of FIG. 1.
Figures 3, 6, 7:
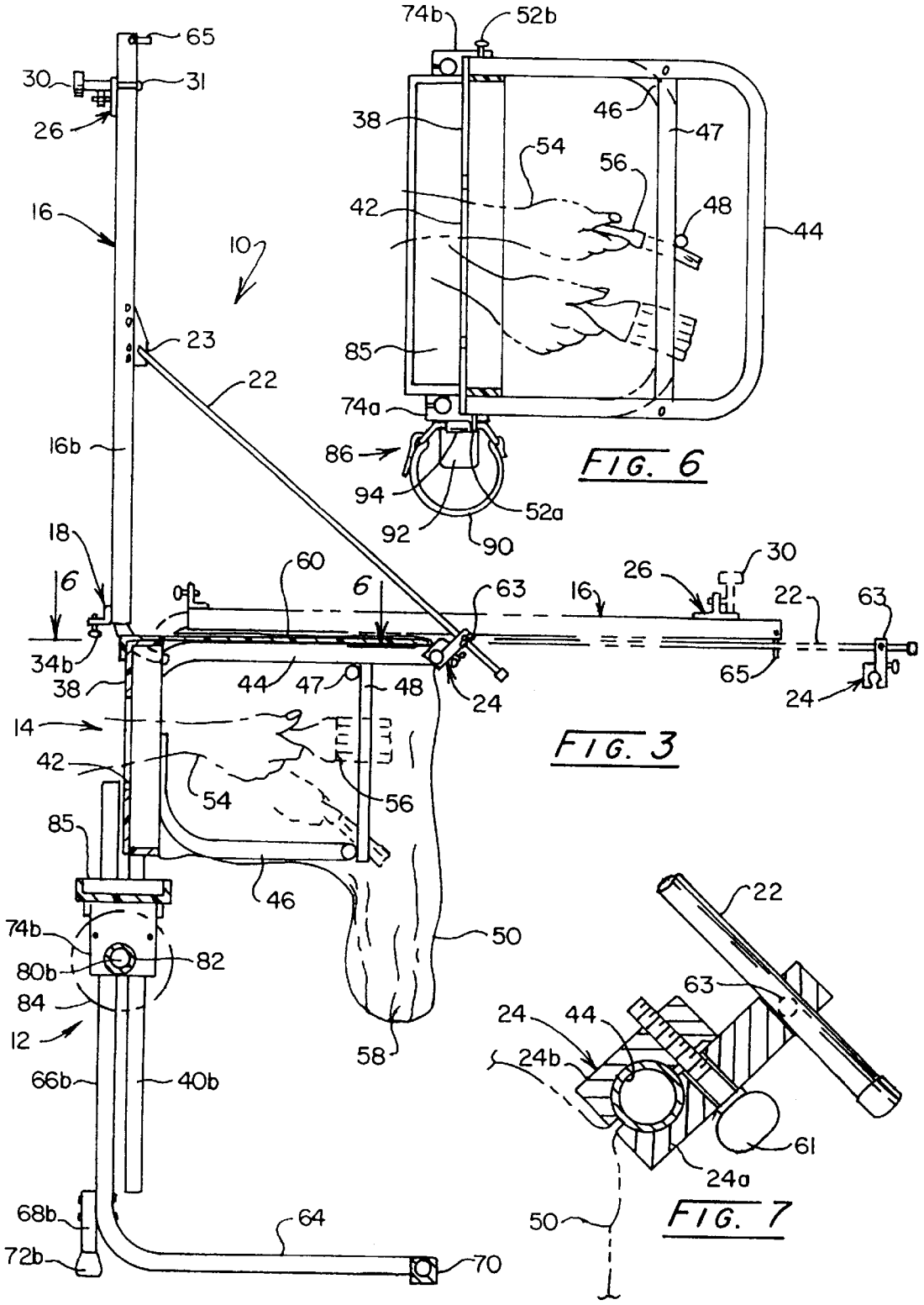
FIG. 3 is a sectional view taken along line 3—3 of FIG. 2.
FIG. 6 is a sectional view taken along line 6—6 of FIG. 3.
FIG. 7 is a sectional view taken along line 7—7 of FIG. 1.

Unique to the inventive easel assembly of the present invention is paintbrush cleaning assembly 14. Referring initially to FIGS. 1, 2, and 3, assembly 14 will be seen to be formed from apertured splatter panel 38, which is secured to upright stand members 40*a* and 40*b* about their upper end, bears aperture 42 which is seen placed to the right of center in splatter panel 38 for a right-handed artist, but easily could be placed left of center for a left-handed artist or in the center as a universal location. The location of aperture 42 is a matter of design judgment of the manufacturer as the present invention is flexible in its design to accommodate virtually any location desired. Assembly 14 also is formed from upper U-shaped bar support member 44 and corresponding lower U-shaped bar support member 46 (see FIGS. 3 and 9). Elongate beater bar 48 is disposed opposite splatter panel 38 by being secured about its lower end to main bar 46 and about its upper end to cross-bar 47 which in turn is connected at either end to the opposite sides of U-shaped member 44. Member 44 has a pair of downwardly projecting legs which permits splatter panel 38 to be affixed thereto. Additionally, such legs can interface with stand 12 as part of its adjustability capability.

Figure 5:
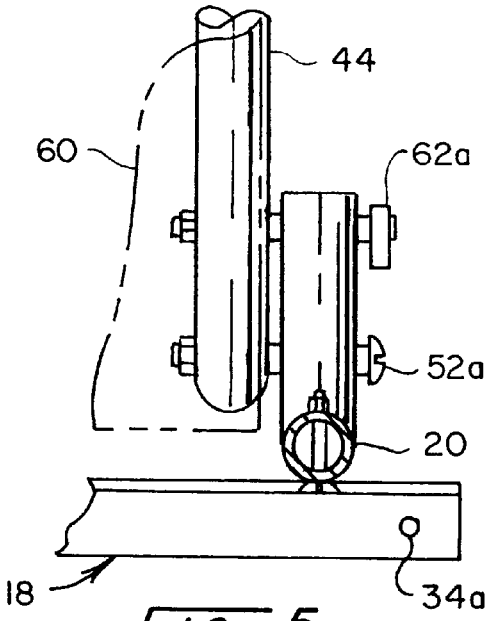
FIG. 5 is a sectional view taken along line 5—5 of FIG. 2.

Member 44, member 46, and splatter panel 38 form an empty cavity wherein the paintbrush is cleaned. Conventional plastic garbage bag 50 is seen to fit over members 44 and 46 with its opening being of about the same size as the periphery of splatter panel 38. Bag 50 is retained in place by catch pins 52*a* and 52*b* (see FIGS. 1, 5, and 6) over which bag 50 can be placed and/or bag 50 can be punctured to be secured by catch pins 52*a* and 52*b*. It should be understood that any bag of appropriate size can be used for containment of solvent being expelled from paintbrush 56. For example, bag 50 can be formed from paper or other cellulosic material, or from a variety polymeric (plastic) material. Cost and availability make conventional plastic garbage bags the bag of choice, however.

A final design feature of paintbrush cleaning assembly 14 is shelf 60 (see FIGS. 5, 6, and 9) which rests atop upper bag support member 44. Bag 50 also fits over shelf 60 so as to provide a storage location for artist supplies. Moreover, anything spilled on shelf 60 will not cause a stain as bag 50 provides effective drop cloth protection thereto.

It should be understood that cleaning assembly 14 also can have its sides, fitted with panels as is its front which is fitted with splatter panel 38 and its top which is optionally fitted with shelf 60. In fact, members 44 and 46 can be integrally formed into such side panels. Since the bag must be able to catch the solvent expelled from paintbrush 56, preferably the bottom and back remain open; although, a bottom panel is possible, especially if inclined towards the back so that the expelled solvent would run down into bag 50. Thus, it is only necessary to provide a frame structure suitable for splatter panel 38 and about which bag 50 can be fitted to be within the scope and precepts of the present invention.

Now referring to FIG. 3, artist's hand and arm 54 (shown in phantom) can be placed through aperture 42 and paintbrush 56 (also shown in phantom) beat against beater bar 48 to expel solvent from brush 56. Brush 56 also can be beat against the transverse section of member 46 to expel solvent. Bag 50 and splatter panel 38 contain the consequent splatter and the mess that would be occasioned thereby. Now, a wet-on-wet artist can easily and quickly dry the paintbrush laden with solvent by use of paintbrush cleaning assembly 14.

Another unique design feature of paintbrush cleaning assembly 14 resides in the displacement of upper member 44 further from splatter panel 38 than the displacement of lower member 46, as shown in FIG. 3. Also, the distance that upper member 44 extends away from splatter panel 38 is less than the length of garbage bag 50. This design permits garbage bag 50 to hang over upper member 44 and form reservoir 58 for retaining solvent splatter expelled from paintbrush 56.

Referring to FIG. 7, it will be observed that clamp 24 is formed from jaws 24*a* and 24*b* that fit about upper bag support member 44. Clamp 24 can be made in 2 parts. Thumb screw 61 can be rotated to tighten clamp 24 so that diagonal bar 22 can be adjusted in length between clamp 24 and pivotal attachment 23 of diagonal bar 22 to canvas support bar 16, thus varying the angle of canvas 36 to the artist. As shown in FIG. 1, clamp 24 clamps around bag 50 to aid in holding it in position, which may be especially useful as reservoir 58 fills up with solvent. Clamp 24 also has a hole through which diagonal bar 22 fits. Diagonal bar 22, in turn, is held in position, and correspondingly so is support bar 16, by thumb screw 63.

Figure 5A:
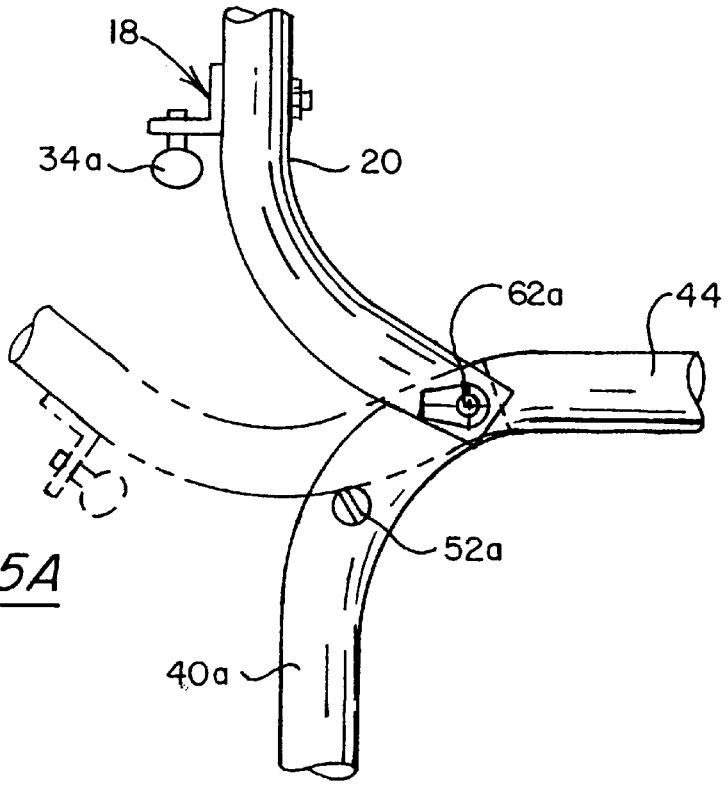
FIG. 5A is a side view of the sectional view in FIG. 5.

In fact, clamp 24 also serves another useful function. As shown in FIG. 3 clamp 24 can be removed from about upper support member 44 to permit canvas support bar 16 to lie down flat on top of shelf 60, which places the easel in a storage and transportation mode. Note, that canvas 36 can remain secured during such storage and transportation mode. Such mode also is made possible because easel hinge member 20 is pivotally connected to upper bag support member 44 by pin 62*a* (see FIGS. 5 and 5A) and 62*b* (not shown but having identical structure as 62*a* on the opposite side). In fact pins 62*a* and 62*b* are removable so as to remove easel 10, for example, for storage and/or transportation as an alternate mode to that depicted in FIG. 3. Pins 52*a* and 52*b* serve as stops for easel 10 when clamp 24 is detached from upper member 44, for example, when changing bag 50. Finally, also when changing bag 50, diagonal bar 22 can be retained by clip 65.

Referring now primarily to FIGS. 1 and 2, adjustable stand 12 is seen to include U-shaped base member 64 having upstanding ends 66*a* and 66*b*. Additional balance is seen to be provided by legs 68*a* and 68*b* which are attached to upstanding ends 66*a* and 66*b*, respectively, and by block 70 (see FIG. 3 also) attached to the transverse section of base member 64. Legs 68*a* and 68*b* preferably are fitted with rubber or plastic caps 72*a* and 72*b*, respectively, which along with block 70, preferably also made of rubber or plastic, retard movement of easel 10.

Now, upstanding ends 66*a* and 66*b*, along with upright stand members 40*a* and 40*b*, are slidably captured by adjusting blocks 74*a* and 74*b*, respectively. As more fully detailed in FIG. 8, adjusting block 74*a* (74*b* being of the same construction) is seen to have 2 holes drilled therethrough of size appropriate for upstanding end 66*a* and upright stand member 40*a* to be slidably passed therethrough. Slots 76*a* and 76*b*, radiate outwardly from the 2 holes bearing upright stand member 40*a* and upstanding end 66*a* so that wing nut and bolt assemblies 78*a* and 78*b* can be tightened and loosened for adjusting the height of easel 10 to accommodate, for example, painters of different heights or painters in a standing or in a seated position, and also for lowering easel 10 for transportation and/or storage (see FIG. 3 in this regard). Adjusting blocks 74*a* and 74*b* preferably are made from a hard plastic material to facilitate the sliding of members 40*a* and 40*b*, and ends 66*a* and 66*b* ) therethrough, although lubrication can be used as is necessary, desirable, or convenient, as can the use of lubricating sleeves which can be placed in the 2 holes drilled in adjusting blocks 74*a* and 74*b*.

Adjusting blocks 74*a* and 74*b* also retain knobs 80*b* (see FIG. 3) and 80*a* (see FIG. 8) which are configured to receive removable roll 82 about which paper towel roll 84 can be placed. The artist or painter can use paper towel roll 84 for general purpose cleaning, e.g., of paintbrush 56, and painters hands, spills, etc. Also, removable tray 85 fits on top of adjustable blocks 74*a* and 74*b* for holding painting supplies, for example.

Adjusting block 74*a* also bears container holder 86 (see FIGS. 1, 2, and 8); although, adjusting block 74*b* also (or in the alternative) could bear holder 86. Container 88 is seen to be held in holder 86 by adjustable Velcro strap 90 and by a two-piece adjustable bracket assembly formed from L-shaped bracket 92 and adjustable bracket with flange or lip 94 which functions to capture the rim of container 88 to hold it securely in position along with Velcro strap 90. Bracket 92 is attached to block 74 with 2 flush head fasteners and bracket 94 is secured to bracket 92 with one flush head screw which passes through an elongated slot in bracket 92 (see also FIG. 9). This elongated slot permits bracket 94 to be raised or lowered to accomodate different sized containers. Container 88 conveniently can retain solvent (e.g., odorless paint thinner) for use by the artist.

The interarrangement between the various primary components making up the novel easel can be seen by reference to FIG. 9 which conveniently depicts adjustable stand 12 and paintbrush cleaning assembly 14 (without easel 10). The major components which in turn make up stand 12 and cleaning assembly 14 also are depicted in FIG. 9.

Material of construction of easel 10 can be metal (e.g., aluminum, steel, etc.), plastic, composite material, or the like including combinations thereof. Base member 64, however, advantageously will be made of higher density material, e.g., steel, to lower the center of gravity of the entire assembly to aid in its stability and prevent it from being tipped over easily. Tubular member may be desired so that the entire assemble is not too heavy which would make it more difficult to move and for cost reduction.

While the invention has been described and illustrated in connection with certain preferred embodiments thereof, it will be apparent to those skilled in the art that the invention is not limited thereto. Accordingly, it is intended that the appended claims cover all modifications which are within the spirit and scope of this invention. All references cited herein are expressly incorporated herein by reference.

I claim:

1. A combination easel and paintbrush cleaning assembly, which comprises:

(A) an easel frame assembly which comprises:
- (a) a pair of generally parallel upright stand members which have lower ends and upper ends;
- (b) a base to support said upright stand members; and
- (c) a horizontal canvas support which extends between said upright stand members; and (B) a paint brush cleaning assembly which comprises:
- (a) a splatter panel with a periphery and an aperture, said splatter panel being affixed to said upright stand members;
- (b) a bag retaining assembly affixed to said upright stand members and configured to define an open cavity having a height which is about the same as the height of said apertured splatter panel; and
- (c) and elongate beater bar which extends vertically within said open cavity and which is affixed to said bag retaining assembly, said bag retaining assembly configured to receive a bag thereover whose opening mates with the periphery of said apertured splatter panel, so that an artist can extend a hand holding a paintbrush through the aperture in said apertured splatter panel to beat the brush against the beater bar to dispel liquid from the paintbrush.

2. The combination easel and paintbrush cleaning assembly of claim 1, wherein said bag retaining assembly is configured to receive a plastic garbage bag.

3. The combination easel and paintbrush cleaning assembly of claim 1, wherein said bag retaining assembly (Bb) comprises:

(Bb1) an upper U-shaped bag support member affixed to said upright stand members and spaced a distance back from said members; and (Bb2) a lower U-shaped bag support member affixed to said upright stand members and spaced a distance back from said members, whereby said upper and lower support members define said open cavity;

said upper and lower bag support members configured to receive said bag which has length thereover whose opening mates with the periphery of said apertured splatter panel.

4. The combination easel and paintbrush cleaning assembly of claim 3, which further comprises:

(m) a shelf which is affixed upon said upper U-shaped bag support member such that said bag is capable of fitting over said shelf when mating said bag with said periphery of said apertured splatter panel.

5. The combination easel and paintbrush cleaning assembly of claim 3, wherein said upper bag support member has a length extending away from said splatter panel and said lower bag support member has a length extending away from said splatter panel which is less than the length of said upper bag support member, and the length of said upper bag support member is capable of being shorter than the length of said bag so that when said bag is placed thereover, the closed end of said bag hangs downward as a solvent collection reservoir.

6. The combination easel and paintbrush cleaning assembly of claim 3, which further comprises:

(f) an upstanding canvas support bar pivotally attached to said upper U-shaped bag support member to support an artists canvas which can rest upon said horizontal canvas support;

(g) a diagonal bar pivotally attached to said canvas support bar at one end and adjustably attached by a clamp member to said upper elongate support member for adjusting the angle of said canvas support bar, said clamp member for retaining said bag placed over said upper and lower U-shaped bag support members.

7. The combination easel and paintbrush cleaning assembly of claim 6, wherein said horizontal canvas support is attached to:

(h) an inverted U-shaped member which is pivotally attached to the upper ends of said upright stand members.

8. The combination easel and paintbrush cleaning assembly of claim 3, which further comprises:

(e) said splatter panel having a top which is affixed to said upright stand members to form an upper junction, and a pair of pins are located at the upper juncture and are carried by either said apertured splatter panel or by said upright stand members, said pins adapted to catch said bag placed over said upper and lower support members.

9. The combination easel and paintbrush cleaning assembly of claim 8, which further comprises:

(f) an upstanding canvas support bar pivotally attached to said upper U-shaped bag support member to support an artists canvas which can rest upon said horizontal canvas support;

(g) a diagonal bar pivotally attached to said canvas support bar at one end and adjustably attached by a clamp member to said upper elongate support member for adjusting the angle of said canvas support bar, said clamp member for retaining said bag placed over said upper and lower U-shaped bag support members.

10. The combination easel and paintbrush cleaning assembly of claim 9, wherein said horizontal canvas support is attached to:

(h) an inverted U-shaped easel hinge member which is pivotally attached to the upper ends of said upright stand members.

11. The combination easel and paintbrush cleaning assembly of claim 3, wherein said base comprises:

(i) a horizontal U-shaped member with upstanding ends;

(ii) a pair of adjusting blocks having holes penetrating through to slidably receive said horizontal U-shaped upstanding ends and to slidably receive the said lower ends of said upright stand members, said adjusting blocks permitting said U-shaped upstanding ends and said upright stand members to independently slide therethrough to selectively adjust the height of said horizontal canvas support.

12. The combination easel and paintbrush cleaning assembly of claim 11, which further comprises:

(j) a container holder for holding a container and being attached to one of said adjusting blocks and comprising an L-shaped member for supporting said container and a slidable member having a lip retaining flange for retaining the lip of said container, said slidable member adjustably attached to said L-shaped member, and an adjustable strap for wrapping around said container.

13. The combination easel and paintbrush cleaning assembly of claim 11, which further comprises:

(k) a tube removably attached between said adjusting blocks and adapted to receive a roll of paper towels.

14. The combination easel and paintbrush cleaning assembly of claim 11, which further comprises:

(l) a tray attached between the adjusting blocks adapted to receive artists supplies.

15. The combination easel and paintbrush cleaning assembly of claim 11, wherein said adjusting blocks comprise:

(1) a pair of generally rectangular blocks which have a pair of elongate holes from top to bottom which holes are adapted to receive said upright stand members ends and said U-shaped member ends, each hole having a slot which extends from each hole to an outer edge of said blocks; and (2) at least two bolt assemblies that are placed transversely through said slots for selectively loosening and tightening said blocks around said upright stand members ends and said U-shaped member ends.

* * * * *